US006893239B2

(12) United States Patent
Pippes

(10) Patent No.: US 6,893,239 B2
(45) Date of Patent: May 17, 2005

(54) INTERNAL GEARED WHEEL PUMP HAVING ASYMMETRIC TOOTH TIPS

(75) Inventor: Reinhard Pippes, Bretten-Sprantal (DE)

(73) Assignee: Eckerle Industrie-Elektronik GmbH, Malsch (DE)

( * ) Notice: Subject to any disclaimer, the term of this patent is extended or adjusted under 35 U.S.C. 154(b) by 65 days.

(21) Appl. No.: 10/415,225

(22) PCT Filed: Sep. 7, 2001

(86) PCT No.: PCT/DE01/03484

§ 371 (c)(1),
(2), (4) Date: Apr. 25, 2003

(87) PCT Pub. No.: WO02/35097

PCT Pub. Date: May 2, 2002

(65) Prior Publication Data

US 2004/0091379 A1 May 13, 2004

(30) Foreign Application Priority Data

Oct. 25, 2000 (DE) ..... 100 52 779

(51) Int. Cl.[7] ..... F04C 2/10
(52) U.S. Cl. ..... 418/171
(58) Field of Search ..... 418/166, 171

(56) References Cited

U.S. PATENT DOCUMENTS 2,389,728 A * 11/1945 Hill ..... 418/166
4,813,853 A 3/1989 Otto et al. ..... 417/295

FOREIGN PATENT DOCUMENTS

DE 25 52 454 6/1976
DE 44 21 255 6/1995
DE 196 51 683 6/1998
DE 198 15 421 10/1999
EP 0 173 778 3/1986
EP 0 736 691 10/1996
GB 1316934 * 5/1973 ..... 418/171
JP 2-27179 * 1/1990 ..... 418/166

OTHER PUBLICATIONS

Die Zahnformen der Zahnräder [The Tooth Forms of Gearwheels] H. Trier, Springer–Verlag 1954).

* cited by examiner

*Primary Examiner*—John J. Vrablik
(74) *Attorney, Agent, or Firm*—Collard & Roe, P.C.

(57) ABSTRACT

The invention relates to an internal geared wheel pump without a filler piece, comprising a housing, an internal geared wheel (3) which rotates in the housing and an external geared pinion (2) which is rotationally mounted in the housing and which meshes with the geared wheel. The teeth of the pinion define a suction area and a pressure area in the gearing, by complete engagement with the tooth spaces of the geared wheel and by sealing contact with tooth crowns of the geared wheel in an engagement-free geared wheel area which lies approximately diametrically opposite the tooth space engagement. The toothing of the geared wheel and the pinion is an involute or cycloid toothing, the tooth crowns having a rounded peripheral surface (23, 34). The tooth crowns of the geared wheel (3) and/or the pinion (2) are asymmetrically rounded in relation to a centre line (40) of each tooth (22, 33), in such a way that a transition line (42) between the tooth face (24, 35) and the peripheral surface (41) is located on the rear tooth face (35) (in the direction of rotation) for the geared wheel and on the front tooth face (24) (in the direction of rotation) for the pinion, closer to the tooth base than on the opposite tooth face, respectively.

6 Claims, 2 Drawing Sheets

Fig. 1
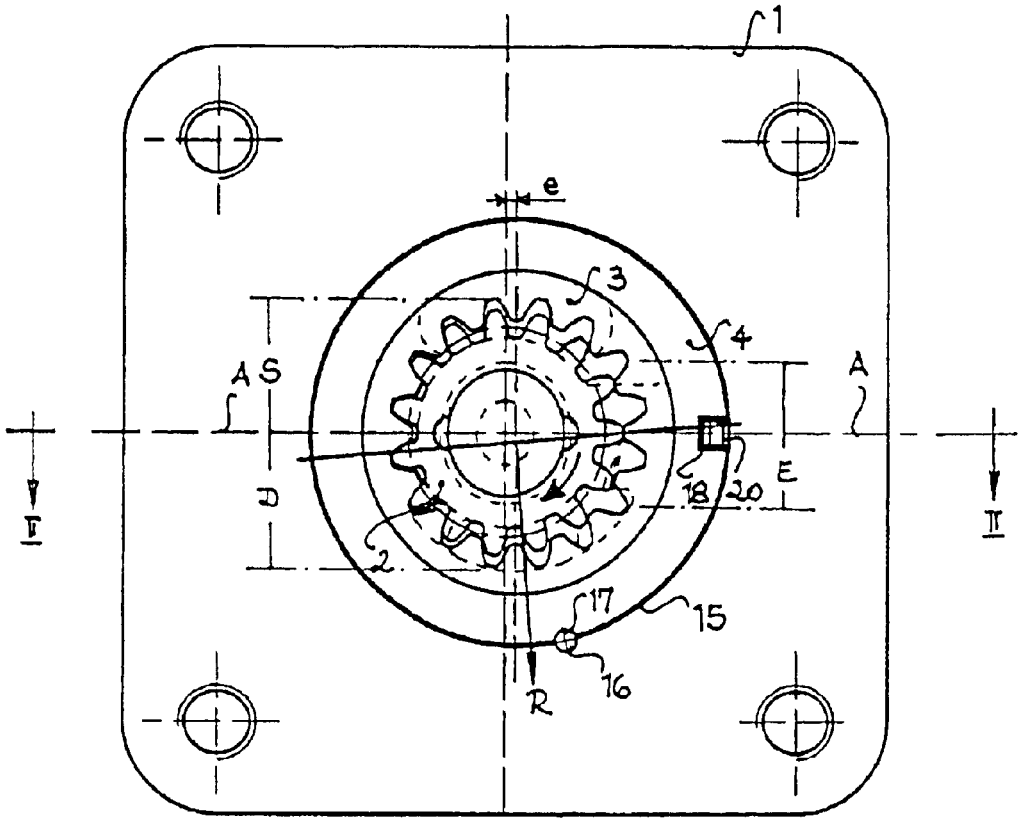
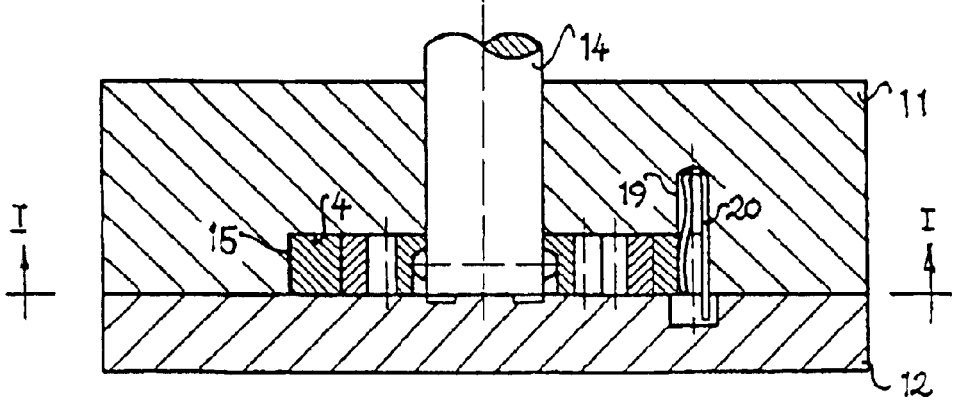
Fig. 2

INTERNAL GEARED WHEEL PUMP HAVING ASYMMETRIC TOOTH TIPS

CROSS REFERENCE TO RELATED APPLICATIONS

Applicant claims priority under 35 U.S.C. §119 of German Application No. 100 52 779.5, filed on Oct. 25, 2000. Applicants also claims priority under 35 U.S.C. §365 of PCT/DE01/03484, filed on Sep. 7, 2001. The international application under PCT article 21(2) was not published in English.

The invention relates to an internal geared wheel pump without a filler piece.

Internal geared wheel pumps or motors without a filler piece have an intermeshing of pinion and ring gear, the teeth of which are sealingly in mutual contact both at mutual engagement in tooth spaces and, approximately diametrically opposite, at the tooth tips located opposite one another, in order thereby to delimit a suction region from a delivery region. Since, in practice, because of unavoidable manufacturing tolerances and on account of the elastic deformations occurring particularly under higher pressures, it is not possible to achieve said sealing contact particularly in that region of the intermeshings in which the tooth tips are to come to bear on one another, measures must be taken in order to ensure this sealing contact under all operating conditions.

For this purpose, in a known internal geared wheel pump of the type initially mentioned, there is provision for the ring gear to be received with radial play in a running ring and to rotate together with the latter. The circumferential surface of the ring gear has axial grooves, in which sealing elements are received radially moveably. As a result, the annular gap between the running ring and the circumferential surface of the ring gear is subdivided into circumferential portions which can be sealed off relative to one another and which are connected, in the delivery region, to a groove acted upon by pressure fluid. As a result, in the annular gap, in one or more circumferential portions, a pressure build-up is provided, which presses the ring gear into engagement with the toothing of the pinion and consequently holds the tooth tips in sealing bearing contact on one another (DE 44 21 255 C1).

In a further known internal geared wheel machine which is likewise included in the generic type initially mentioned, the sealing contact of the tooth tips of pinion and ring gear with respect to the engagement region is ensured in that the ring gear is arranged rotatably in a bearing ring moveable transversely to the axis of said ring gear, but received nonrotatably in the housing. The bearing ring is pivotable relative to the housing about a pivot axis parallel to the axis of said bearing ring. The pivot axis lies in such a way that that annular portion of the bearing ring which is assigned to the engagement-free ring gear region is moved at least approximately radially to the pinion axis by the pressure forces acting on the ring gear in the delivery space, with the result that the tooth tips are held in mutual sealing contact in the engagement-free ring gear region (DE 196 51 683 A1).

Versions of these known internal geared wheel pumps which have been implemented in practice have in each case, for ring gear and pinion, an involute toothing, in which the tooth flanks are configured as involute curves and the tooth tips have a circumferential surface deviating from the involute form, usually a circular-cylindrical surface. In this type of toothing, the teeth of pinion and ring gear come out of contact, in regions, in suction space, that is to say between full tooth engagement and the engagement-free ring gear region, and approach one another again only shortly before the engagement-free region in which the tooth tips are to come to bear sealingly against one another. In this case, jolt-like contacts of the tooth edges in the transitional region between the tooth flank and the circumferential surface of the teeth may occur, as a result of which the sealing action of the circumferential surfaces, bearing on one another, of the tooth tips is impaired and considerable running noises may occur. In order to eliminate these disadvantages, in these known internal geared wheel pumps the tooth tips are rounded, that is to say the tooth edges are set back at the transition between tooth flank and circumferential surface. However, a complete success in improving the sealing action, particularly under high pressures, has not yet been achieved as a result.

U.S. Pat. No. 4,813,853 A disclosed an internal geared wheel pump without a filler piece, with a housing and an internally toothed ring gear rotating therein and with an externally toothed pinion mounted rotatably in the housing and meshing with the ring gear, in which pump sealing contact takes place in the region of the toothed flanks. The tooth tips of ring gear and pinion are configured asymmetrically in such a way that, in the region of tooth space engagement, the contact ratio is lower on the drive side of the tooth flanks than on the sealing side of the tooth flanks. This design can be used expediently only in the case of low pressures and high throughputs. The sealing action between the teeth of ring gear and pinion is unsatisfactory.

The object of the invention is to provide an internal geared wheel pump of the type initially mentioned, in which the sealing action between the tooth tips is improved and the generation of noise is reduced.

This object is achieved, according to the invention, by means of a configuration of the generic internal geared wheel pump as described herein.

Since the tooth tips either of the pinion or of the ring gear or of both gearwheels have an asymmetrically set-back circumferential surface, the tooth tips, when they approach one another in the engagement-free ring gear region, can first meet one another in a jolt-free manner. As they continue to come to bear on one another, the tooth tip circumferential surfaces come into contact via that part of these which is set back to a lesser extent on account of the asymmetry. A satisfactory sealing off of the tooth tips against one another is thereby obtained. In this case, the set-back surface commences at the tooth flanks of ring gear and pinion which are located opposite one another during the approach and immediately before the meeting and a smooth run of the tooth tips one onto the other is thereby obtained. According to an advantageous development, that part of the asymmetric circumferential surface which lies nearer to the tooth root extends from the transition to the tooth flank as far as the tooth center line or even into that region of the circumferential surface of the tooth tip which lies on the far side of the tooth center line with respect to said transition. Consequently, approximately half the original circumferential or rounding surface not corrected according to the invention is preserved for the purpose of sealing off.

The extent of the tooth tip set-back naturally depends on the model size. It therefore expediently amounts to 0.02–0.1 times the toothing modulus m, as measured from the transition between the uncorrected circumferential or rounding surface and the tooth flank.

Further advantages and features of the invention may be gathered from the following description of exemplary embodiments with reference to the accompanying drawings in which:

FIG. 1 shows a cross section along the line I—I in FIG. 2;

FIG. 2 shows an axial section along the line II—II in FIG. 1;

Figure 3:
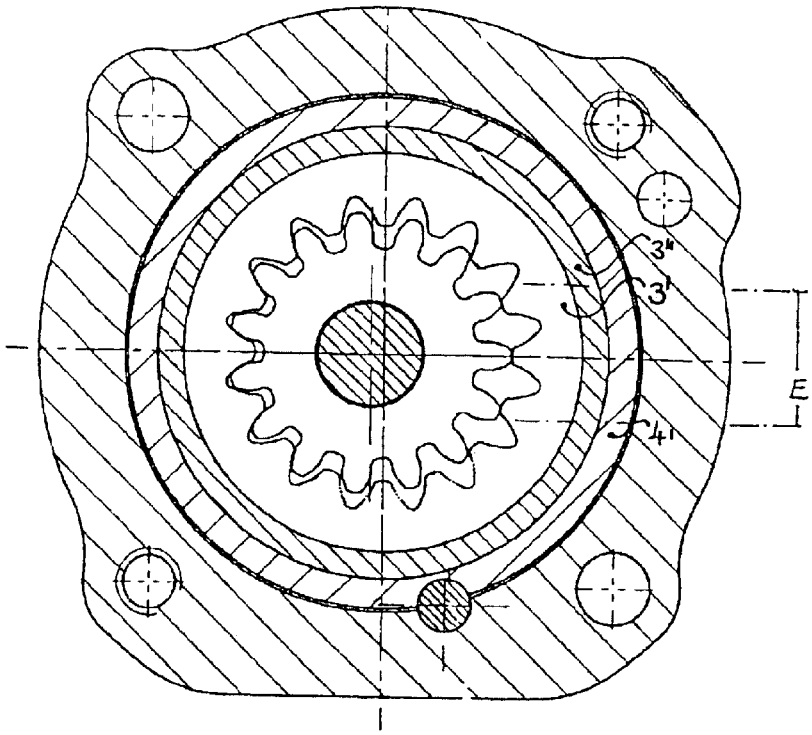
FIG. 3 shows a section, similar to FIG. 1, of a modified embodiment.

The internal geared wheel pump illustrated in FIGS. 1 and 2 comprises a housing, designated as a whole by 1, which is composed of a bowl-shaped housing part 11 and of a housing cover 12 fastened to the end face of the latter. Mounted rotatably in the bowl-shaped housing part 11 is a pinion shaft 14, on which a pinion 2 is fastened fixedly in terms of rotation. The pinion 2 meshes with the ring gear 3 which is received in a bearing ring 4 and which is mounted rotatably therein. As may be gathered from FIG. 1, the pinion 2 and the ring gear 3 are mounted relative to one another with an eccentricity e. The eccentricity e, that is to say the distance between the pinion axis and the ring gear axis, corresponds to the theoretical toothing geometry of pinion and ring gear and presupposes a play-free rolling or sliding of the toothings on one another. The toothings of the pinion 2 and of the ring gear 3 mesh with one another in such a way that, on the left side in FIG. 1, in the region of the parting line A, the teeth of the pinion 2 engage fully into the tooth spaces of the ring gear 3 and come to bear on the tooth flanks, while, on the opposite side, on the right in FIG. 1, they have emerged completely from the tooth spaces of the ring gear 3. In this engagement-free ring gear region E, a plurality of the tooth tips of the pinion 2 and of the ring gear 3 (in each case 3 tooth tips in the exemplary embodiment shown) are supported on one another successively in the course of rotation. The numbers of teeth and the geometry of the intermeshing toothings are selected such that this type of meshing can be brought about. In the exemplary embodiment shown, the ring gear 3 and the pinion 2 have in each case an involute toothing, that is to say the tooth flanks have an involute contour. The number of teeth of the ring gear 3 differs from that of the pinion 2 by 1.

During the rotation of the pinion 2 in the direction indicated by the arrow, the freed tooth space volume increases, starting from the full engagement of the pinion toothing into the ring gear toothing above the parting line A and increasing until the state evident from FIG. 1 is reached, during the renewed passage over the parting line A (on the right side in FIG. 1). The suction space S of the internal geared wheel pump is thereby formed above the parting line. Below the parting line, the free tooth space volume is increasingly reduced again, so that the delivery space D is thereby formed. In FIG. 1, the suction space S and the delivery space D are indicated in their projection, but it goes without saying that the suction space S and the delivery space D in each case extend in the circumferential direction within the toothing.

The bearing ring 4 is received in a housing bore 15 of the bowl-shaped housing part 11 with a radial play of about 0.2 mm. The wall of the housing bore 15 has passing partially through it a bearing pin 16 which is pressed firmly into the bottom of the housing bore 15. The bearing pin 16 is received, with its largely semi-cylindrical part projecting beyond the wall of the housing bore 15, in an axially directed groove 17 of the bearing ring 4. The axial groove 17 is adapted to the form of the bearing pin 16 and is likewise part-cylindrical.

The bearing pin 16 engaging into the axial groove 17 forms, for the bearing ring 4, a pivot axis which runs parallel to the axes of pinion 2 and ring gear 3 and about which the bearing ring 4 is pivotable in the housing bore 15 within the available radial play. As may be gathered from FIG. 1, this pivot axis lies in a quadrant of the bearing ring 4 which extends between the engagement-free ring gear region E and the center of the delivery space D. In the exemplary embodiment shown, the pivot axis is located at an angular distance of about 80° from the vertex of the engagement-free ring gear region E. At this vertex, two teeth of pinion and ring gear stand with their tooth tips on and largely in alignment with one another.

The internal geared wheel pump according to FIGS. 1 and 2 operates as follows:

During the rotation of the pinion 2 in the direction of rotation shown, feed medium is fed through a suction duct, not shown, into the suction space S between the toothings of the pinion 2 and of the ring gear 3. The feed medium is pressed at increased pressure out of the delivery space D through a delivery duct, not shown. The relevant construction of an internal geared wheel pump is sufficiently known and therefore does not need any special explanation.

The pressure forces, prevailing in the delivery space D, between the intermeshing toothings act along a resultant R in such a way that the ring gear 3 seeks to move away from the pinion 2, that is to say there is the tendency that the contact existing between the teeth of pinion 2 and ring gear 3 by virtue of the toothing geometry, in particular the sealing contact between the tooth tips in the engagement-free ring gear region E, is lost. However, the pivot axis of the bearing ring 4, said pivot axis being formed by the bearing pin 16 or the engagement of the latter into the axial groove 17, lies nearer to the engagement-free ring gear region E than the line of the resultant R. Since the resultant R acts on the bearing ring 4 via the ring gear 3, a torque is thus generated about the pivot axis 16, 17 counterclockwise in FIG. 1. By means of this torque, the bearing ring 4 is pivoted about the pivot axis 16, 17, with the result that the annular portion corresponding to the engagement-free ring gear region E is moved approximately radially with respect to the pinion axis and toward the latter. Consequently, in the engagement-free ring gear region E, the tooth tips of pinion 2 and ring gear 3 are moved relative to one another with a force which is proportional to the size of the resultant R. Sealing contact is thereby maintained in this toothing region in a pressure-proportional manner.

The bearing ring 4 has, at a point assigned to the vertex of the engagement-free ring gear region E, a further axial groove 18 with a rectangular cross section on its outer circumference. This axial groove 18 is assigned, in the bottom of the housing bore 15, a receiving bore 19 in which a hairpin spring 20 is held. The hairpin spring 20 projects into the axial groove 18 and loads the bearing ring 4 radially in such a way that the teeth of the ring gear 3 are pressed with their tooth tips against one another in the engagement-free ring gear region E. This loading direction corresponds largely to the direction of movement which the bearing ring 4 executes about the pivot axis 16, 17 as a result of the pivoting movement. The force of the hairpin spring 20 may be kept relatively low, since it serves merely to ensure the necessary sealing contact between the tooth tips in the engagement-free ring gear region E during the operation of starting the internal geared wheel pump, that is to say at a time when there is still no operating pressure built up in the delivery space D and therefore also no pressure forces yet take effect.

The position and direction of the resultant R are largely predeterminable and correspond essentially to those depicted in FIG. 1. The pressure build-up in the delivery space D can be influenced in a known way by means of prefilling slots on the teeth of the pinion 2 and/or ring gear 3, so that a largely identical pressure prevails, for example, over the tooth spaces of the delivery space D. In this case, the resultant R is perpendicular to the line, illustrated, unbroken, in FIG. 1, which connects the vertex of the engagement-free ring gear region E to the pinion tooth in the event of full engagement into a tooth space of the ring gear.

The embodiment according to FIG. 3 differs from that according to FIGS. 1 and 2 essentially in that the ring gear 3' is widened in a known way on its outer circumference in the axial direction to form a running ring 3", in order to keep the specific bearing pressure in the bearing ring 4' low. Moreover, a pressure spring 20 is dispensed with. As regards the axially widened running surface of the ring gear 3', which projects on both sides beyond the side faces of the ring gear and pinion and the cross section of which may be gathered from FIG. 3, but which is not important to the present invention, reference is made to DE 198 15 421 A1.

The operation of this embodiment corresponds to that of the embodiment according to FIGS. 1 and 2.

Figure 4:
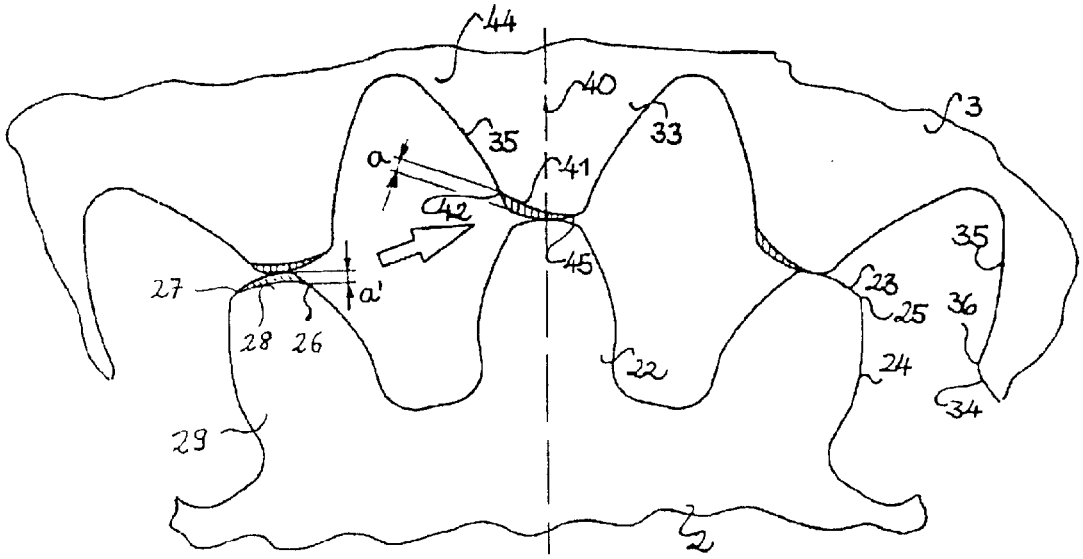
FIG. 4 shows an illustration of the engagement-free ring gear region of the two above embodiments on a greatly enlarged scale in order to make clear the tooth tip set-back according to the invention.

In FIG. 4, the engagement-free ring gear region E of the two above embodiments is reproduced, enlarged, as a detail. What is shown are the toothings with the uncorrected tooth form and, for the ring gear, with the tooth form corrected according to the invention. The teeth 22 and 33 of the pinion 2 and ring gear 3 are in a relative position in which they have moved toward one another, in the direction of rotation indicated by the arrow, to an extent such that their outer circumferential surfaces 23 and 34 are located at least partially opposite one another and bear on one another. The circumferential surfaces 23, 34 may be uncorrected part-cylindrical surfaces having the tip diameter of the respective toothing or having a smaller diameter (see DIE ZAHNFORMEN DER ZAHNRÄDER [THE TOOTH FORMS OF GEARWHEELS] H. Trier, Springer-Verlag 1954) and, with the respective involute flank 24 and 35, form a transitional line 25 and 36 which, in practice, is always rounded to form a transitional region. In the case of an uncorrected tooth tip, this applies to the front and rear tooth flanks of the teeth 22 and 33 in the direction of rotation.

In the exemplary embodiment shown, according to FIG. 4, the teeth 33 of the ring gear 3 and of the pinion 2 are corrected according to the invention. That is to say, with respect to a tooth center line 40, which here at the same time constitutes a tooth axis of symmetry or plane of symmetry, the teeth 33,22 are set back asymmetrically in the tip region. As a result, starting from the uncorrected circumferential surface 34,23, a set-back surface 41,28 is provided, of which the transitional line 42,26 to the involute flank 35,24 lies nearer to the tooth root 44,23 than the transition 36,25 of the same tooth 33,22 on the opposite side. To make the set-back clearer, the extent of the material quantity removed, starting from the uncorrected contour of the toothing, is illustrated, exaggerated, in FIG. 4 by hatching. In general, a set-back amount a,a' of between 0.02 m and 0.1 m (m=toothing modulus, measured in mm) is useful. It is clear from the illustration that the set-back surface 41,28 may extend as far as a transitional line 45,27 into that region of the original circumferential surface 34,23 which already lies on the far side of the center line 40 with respect to the tooth flank 35,24. The set-back surface may also run completely as far as the opposite tooth flank, while the transitional line 45,27 may coincide with the transitional line 36,25 or even lie in the adjoining tooth flank or else be shorter than illustrated, for example such that about half the circumferential surface 34,23 available for sealing off before the correction is preserved. In the former case, care must be taken to ensure that the deviation of the set-back surface 41,28 from the uncorrected circumferential surface 34,23 is low in the portion located on the far side of the center line 40, so as not to impair sealing contact.

In the exemplary embodiment shown, the set-back surface 41,28 has a smooth continuous run and may in all instances be a cylindrical, in particular circular-cylindrical surface. The radius of this surface can, in principle, be selected within wide limits which are determined merely by the size of the toothing and by what extent of the set-back surface 41,28 toward the opposite tooth flank is desired. It goes without saying, in this case, that intersections (transitional lines 42,26, 45,27) which occur are rounded or smooth, so as to avoid any edges.

Only the teeth 33 of the ring gear 3 or the teeth 22 of the pinion 2 may be corrected in a corresponding way. In this last case, the transitional line 26, corresponding to the transitional line 42, from the set-back surface to the involute flank 24 lies on the involute flank shown on the right in FIG. 4.

By means of the described correction of the teeth 33,22, when the teeth 22 and 33 run toward one another, the circumferential surfaces 23,34, more precisely their transitional edges 25,36, can run onto the set-back surfaces 41,28 smoothly and in a jolt-free manner and ultimately are pressed in the way outlined above onto that part of the circumferential surface 34,23 which has remained and which ensures that the tooth tips are sealed off. In general, however, the set-back according to the invention of the tooth tips and its function are irrespective of the type of pressing of the tooth tips on one another.

The set-back of the tooth tips may take place during manufacture by subsequent grinding after the generation of the uncorrected toothing or of a DIN toothing or even during the generation of the toothing by means of a corresponding tool profile.

There may, within the scope of the invention, be a difference from the above exemplary embodiments. Thus, instead of the involute toothing, a cycloid toothing may be provided on the gearwheels. Furthermore, the internal geared wheel pump may be equipped in a known way with axial pressure plates, particularly in the case of higher operating pressures.

What is claimed is:

1. An internal geared wheel pump without a filler piece comprising:

(a) a housing;

(b) an internal geared wheel which rotates in the housing;

(c) an externally geared pinion rotatably mounted in the housing, said pinion meshing with the geared wheel and having teeth defining a suction area and a pressure area in the gearing by complete engagement with tooth spaces of the geared wheel and by sealing contact with tooth crowns of said geared wheel in an engagement-free geared wheel area located approximately diametrically opposite the tooth space engagement, the toothing of the geared wheel and the pinion being an involute or cycloid toothing, the tooth crowns having a rounded peripheral surface, the teeth of the pinion and the geared wheel having teeth faces that are symmetric in relation to a center line of each tooth, the rounded peripheral surface of the tooth crowns of the geared wheel and/or the pinion being set-back asymmetrically on the rear tooth face in the direction of rotation for the geared wheel and on the front tooth face in the direction of rotation for the pinion, starting from an uncorrected tooth form designed symmetrically in relation to the center line of each tooth to provide a corrected tooth form in such a way that a transition line between a tooth face and the peripheral surface is located on the rear tooth face in the direction of rotation for the geared wheel and on the front tooth face in the direction of rotation for the pinion, closer to the tooth base than on the opposite tooth face, respectively, wherein the asymmetrically rounded peripheral surface extends continuously between the tooth faces of each tooth.

2. The internal geared wheel pump according to claim 1 wherein each of the set-back surface and the uncorrected peripheral surface comprises a circular-cylindrical surface.

3. The internal geared wheel pump according to claim 1 wherein the peripheral surface comprises a circular-cylindrical surface.

4. The internal geared wheel pump according to claim 1 wherein the set-back of the tooth crown (in mm) measured from a transition between the uncorrected peripheral surface and the tooth face is in the range of 0.02 m to 0.1 m (m=toothing modulus).

5. The internal geared wheel pump according to claim 1 wherein said peripheral surface comprises a set-back surface and an uncorrected peripheral surface.

6. The internal geared wheel pump according to claim 5 wherein the transition line between the set-back surface and the uncorrected peripheral surface lies near the tooth center line.

* * * * *